US005236216A

United States Patent [19]

Ratzek

[11] Patent Number: 5,236,216

[45] Date of Patent: Aug. 17, 1993

[54] BINDING FOR SNOWBOARDS

[75] Inventor: Thomas Ratzek, Geretsried, Fed. Rep. of Germany

[73] Assignee: F2 International Ges.m.b.H., Kirchdorf/Krems, Austria

[21] Appl. No.: 908,225

[22] Filed: Jul. 2, 1992

[30] Foreign Application Priority Data

Jul. 10, 1991 [DE] Fed. Rep. of Germany ... 1908513[U]

[51] Int. Cl.[5] ..... A63C 5/03; A63C 5/00

[52] U.S. Cl. ..... 280/607; 280/14.2

[58] Field of Search ..... 280/14.2, 607, 618, 280/620, 633, 634, 636; 441/70

[56] References Cited

U.S. PATENT DOCUMENTS

| | | | |
|---|---|---|---|
| 4,728,116 | 3/1988 | Hill | 280/618 |
| 4,871,337 | 10/1989 | Harris | 280/14.2 X |
| 4,964,649 | 10/1990 | Chamberlin | 280/14.2 X |
| 5,028,068 | 7/1991 | Donovan | 280/14.2 X |
| 5,044,654 | 9/1991 | Meyer | 280/14.2 X |

FOREIGN PATENT DOCUMENTS

| | | | |
|---|---|---|---|
| 0351298 | 1/1990 | European Pat. Off. | 280/14.2 |
| 0398794 | 11/1990 | European Pat. Off. | 280/14.2 |
| 3603258 | 10/1987 | Fed. Rep. of Germany | 441/70 |
| 2233081 | 1/1975 | France | 280/618 |
| 2627097 | 8/1989 | France | 280/607 |
| 2645037 | 10/1990 | France | 280/14.2 |

OTHER PUBLICATIONS

A folder by the Limbo Company entitled "Radical Binding System, Light Rotation-Drehtellerbindung" (export leaflet Aug. 1989).

A folder by the Elfgen Company (No. 1001.91) discloses bindings designated "Soft 7000", Soft-Quick 1800, Multi-Twist 6000 and Rotations-Front-Quick 1600. Date unknown.

A folder by the Elfgen Company entitled "Deck-Step" and Quick-Step (No. 1002.91). Date unknown.

p. 162, Snowboard Test Special designating the Emery Speedy Surf. Date unknown.

*Primary Examiner*—Brian Johnson

*Attorney, Agent, or Firm*—Ralph H. Dougherty

[57] ABSTRACT

A binding for snowboards comprises a rotatable base plate (1) which, when mounted, is directly in contact with the surface of the snowboard (25). The base plate (1) includes a circular central opening (2) through which protrudes a circular fastening disc (14) formed with a projecting rim (15) which extends over the opening (2) in the base plate. The fastening disc (14) is adapted to be threadedly engaged with the snowboard (25), thus pressing the base plate against the snowboard. The fastening disc has oblong holes (18, 19, 20, 21) which allow longitudinal shifting of the entire binding.

7 Claims, 3 Drawing Sheets

BINDING FOR SNOWBOARDS

FIELD OF THE INVENTION

The present invention relates to a binding for snowboards comprising a rotatable base plate and means for fastening the base plate on the snowboard. A great variety of snowboard bindings of this kind are commercially available.

BACKGROUND OF THE INVENTION

A binding which has a fastening foundation directly screwed together with the snowboard and a base plate adapted to be attached for rotation to the foundation by means of a central bolt is described in a folder by the Limbo Company, entitled "Radical Binding System, Light Rotation-Drehtellerbindung" (export leaflet 08/89). The foundation includes two approximately circular openings which pass over into each other, together presenting the shape of a FIG. 8, and each formed along the edges with indentations of circular segmental configuration. For this reason the base plate can be adjusted only in corresponding steps of 12°. A binding thus can be shifted in a forward or backward direction by 4 cm, depending on which of the two recesses is selected to receive the base plate. This binding does not permit fine adjustment of the step span and/or rotary position. If one takes into account that the oblique position of the binding with respect to the longitudinal axis of the snowboard is between 40° and 45° and the step span in most cases is adjusted to between 40 and 46 centimeters, it becomes apparent that the possibilities for adjustment of this binding are insufficient and, therefore, the initial attaching of the binding becomes decisive for the proper position of the binding. This in turn means that the binding can be fixed to the board exclusively with so-called ski screws, and they do not provide the required retaining forces, with the snowboards getting ever thinner, unless they are used in great numbers which, of course, involves a great many threaded holes. For this reason most snowboard manufacturers have begun inserting threaded bushings, called inserts, at predetermined positions in the snowboard. Hereby the location of the binding is largely predetermined. The known binding thus does not provide the possibility of making useful adjustments.

A folder by the Elfgen Company (no. 1001.91) discloses bindings, designated "Multi-Twist 6000" and "Rotations-Front-Quick 1600", which likewise comprise a foundation resting directly upon the snowboard, while the base plate of the binding is secured to the upper side of this foundation by a central bolt. One of these bindings permits fixation in several rotational positions by virtue of the rotary plate having a plurality of perforated index positions engaged by a grub screw which is secured to the base plate. Oblong holes allow the binding to be adjusted infinitely in longitudinal direction with respect to the foundation.

Similar bindings are described in a folder by the Elfgen company entitled "Deck-Step" and "Quick-Step" (no. 1002.91). In the case of the plate-type binding shown in that publication the foundation is subdivided into two parts and a base plate can be mounted in various rotational and longitudinal positions of alignment due to a greater number of threaded bores in offset arrangement.

Another binding on the market, designated "Emery Speedy Surf" includes a foundation threaded directly on the snowboard and having an oblong hole which provides rotary support to a nut in two offset threaded bores. The base plate is arranged on top of this and, on top of the base plate, finally, there is a fastening plate which is screwed together with the fastening nut by two screw bolts. This structure is relative complex and costly. In addition, two screws must provide the full retaining force via the fastening nut.

All the bindings described above are so-called plate-type bindings. The snowboard boot is attached to them by front and heel clips affording very firm seating of the boot.

Another usual type of binding are the so-called soft or shell-type bindings (cf. the Elfgen leaflet no. 1001.91 quoted above) called "Soft-Quick 1800" or "Soft 7000". These bindings retain the shoe by no more than two straps and a tail spoiler. These bindings allow much greater movability of the shoe with respect to the snowboard and are suitable above all for free style runners. The bottom plate of these soft bindings, in contact with the snowboard surface, includes a plurality of holes so that these bindings can be mounted in accordance with the hole pattern which does permit certain adjustments.

OBJECT OF THE INVENTION

It is the principal object of the invention to provide a snowboard binding of simple structure, permitting fine adjustment, while being easy to mount.

SUMMARY OF THE INVENTION

This object is met, in accordance with the invention, by providing a binding for snowboards of the type specified initially, wherein the bottom surface of the base plate, in assembled state, is directly in contact with the surface of the snow-board, wherein the base plate includes a circular central opening through which protrudes a circular fastening disc formed with a projecting rim which extends over the opening in the base plate and presses the base plate against the snow-board, and wherein the fastening disc is adapted to be screwed together with the snowboard.

In contrast to the known bindings described above, the base plate rests directly on the surface of the snowboard rather than on a rotary plate. Thus the fastening disc used with the invention and, in some way, fulfilling the function of the rotary plate, in part lies above the base plate and holds down the base plate by the full surface area of its projecting rim. Upon easy loosening of the fastening bolts of the fastening disc, the base plate can be turned through any desired angle, whereby fine adjustment can be achieved. Of course, it is possible to switch from "goofy" to "regular".

Moreover, as the base plate is retained by the full surface area of the projecting rim of the fastening disc, the force is distributed favorably to the retainer screw bolts.

In another embodiment of the invention, the fastening disc includes oblong holes through which the bolts are passed. Due to these oblong holes, the position of the fastening disc can be varied in longitudinal direction of the snowboard so that, on the one hand, the step span or width, i.e., the center spacing of the right and left bindings, and, on the other hand, the central position of the two bindings, can be adjusted when both bindings are displaced in parallel with each other in forward or backward direction (based on the longitudinal direction of the snowboard). For instance, if the length of the oblong holes is selected at 4 cm the step span is adjustable by up to 8 cm, or both bindings can be shifted by up to 4 cm to the front or to the rear.

According to a further embodiment of the invention, four oblong holes are provided which are arranged in pairs in parallel, the respective ends of the oblong holes representing the corners of a square. In this case the snowboard comprises four inserts, i.e. threaded bushings, arranged in a square and symmetrically with respect to the central axis of the snowboard. In spite of this small number of inserts (some bindings require up to 16 inserts for different positions) a wide range of binding adjustment is obtained as well as a convenient distribution of forces. Moreover, tensional forces of the binding, in part occurring also parallel to the longitudinal direction of the shoe sole, have no negative influence on any flexing of the snowboard substantially transversely of the direction of movement, as is the case indeed with other plate-type bindings, especially the so-called divided plate-type bindings.

Precise adjusting of the binding in longitudinal direction of the snowboard is allowed, according to a further development of the invention, in that the fastening disc is formed with a breakthrough in the form of a window through which marks are visible that are applied on the surface of the snowboard.

In consideration of the fact that the position of the base plate with respect to the plane of the surface of the snowboard is fixed essentially by frictional forces, the bottom surface of the base plate may have a friction lining, such as, for example, a rubber or elastomer layer. This increases not only the frictional forces, but also provides a certain flexibility to dampen shocks.

Moreover, as the fastening disc and the base plate are secured essentially by friction alone as regards their rotational position, it is provided in a further development of the invention that the bottom surface of the projecting rim of the fastening disc and/or the associated contact surface at the upper side of the base plate is/are roughened, knurled or formed with some microtoothing as this will offer improved slip protection. Instead of these measures, or in addition, a rubber ring may be inserted between the projecting rim and the base plate. In addition, such a ring not only enhances the frictional behavior but also affords damping.

Finally, it should be noted that the invention is applicable both with plate-and shell-type bindings. In the case of a plate-type binding, heel and front clips are mounted on the base plate to secure the ski shoe or boot on the base plate, if desired, by way of intermediate wedges causing the shoe sole to adopt an inclined position. In the case of a shell-type binding, the bottom of the binding serves as base plate and, as for the rest, all the other features of the invention may be applied.

Another essential advantage of the binding according to the invention is its easy assembly, meaning that even an unskilled person can mount the binding on the snowboard. A uniform aperture pattern for the inserts allows plates or soft bindings to be mounted, and very fine-grade, individual adjustment can be accomplished without much expenditure. Finally, the binding can be switched with only a little manipulation from "goofy" to "regular".

BRIEF DESCRIPTION OF THE DRAWINGS

The invention will be described further, by way of example, with reference to the accompanying drawings, in which.

DESCRIPTION OF THE PREFERRED EMBODIMENT

Figure 1:
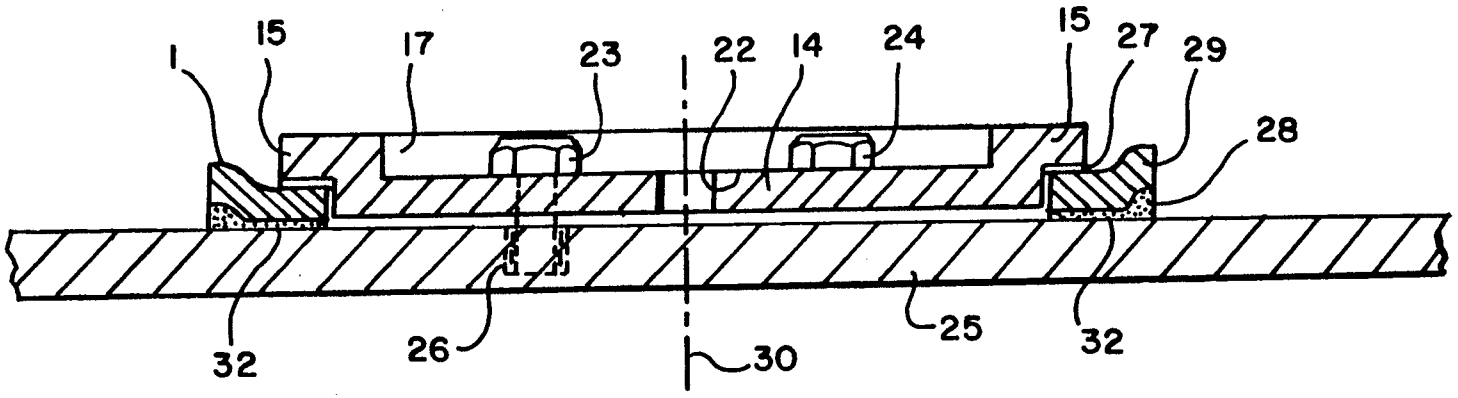
FIG. 1 is a cross sectional view of an assembled binding.
Figure 2:
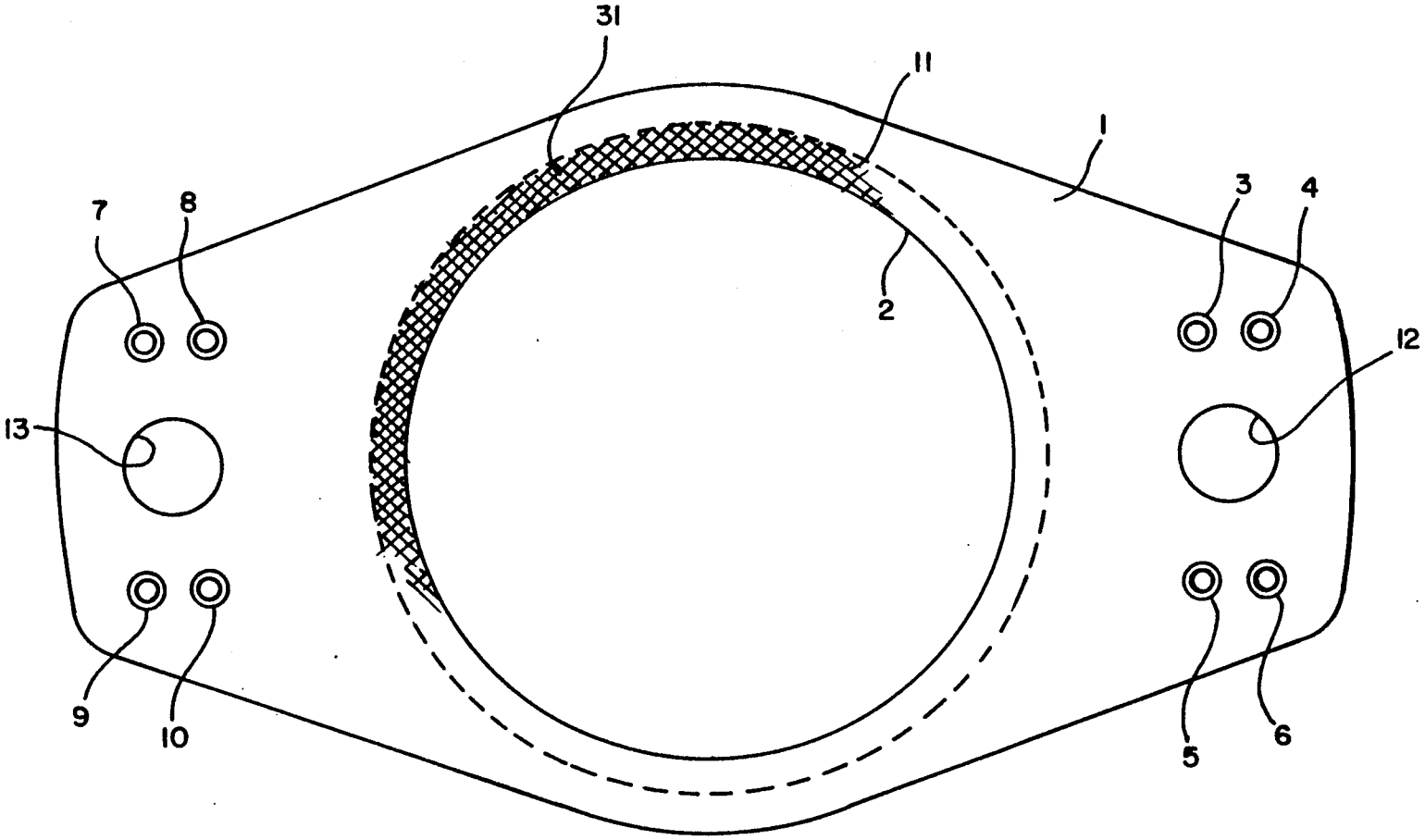
FIG. 2 is a top plan view of the base plate of the binding.

The base plate 1 is a substantially flat, elongated plate which, fundamentally, may have any desired shape. In the illustrated embodiment it has approximately the configuration of a diamond with rounded edges. The base plate 1 has a circular central opening 2 the diameter of which, based on the width of the plate, is so great that only a relatively narrow margin of about 1 to 2 cm remains at the sides. At either end there are four threaded bores 3, 4, 5, 6 and 7, 8, 9, 10, respectively, where fastening discs with front or heel clips, respectively, can be fixed by screw threaded engagement.

The opening 2 is surrounded by a supporting edge 11, as indicated by a discontinuous line, which may be roughened, knurled or formed with fine teeth as generally indicated at 31.

Greater apertures 12 and 13 may be seen between the threaded bores 3 to 10. They serve to diminish the weight of the structure.

The bottom surface of the base plate 1 may carry a friction coating or lining, such as a rubber mat, as generally indicated at 32.

Figure 3:
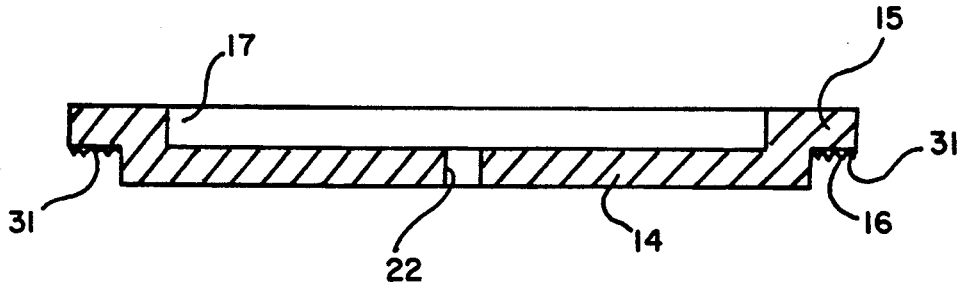
FIG. 3 is a cross sectional view of the fastening disc of the binding taken along line 3—3 of FIG. 4.
Figure 4:
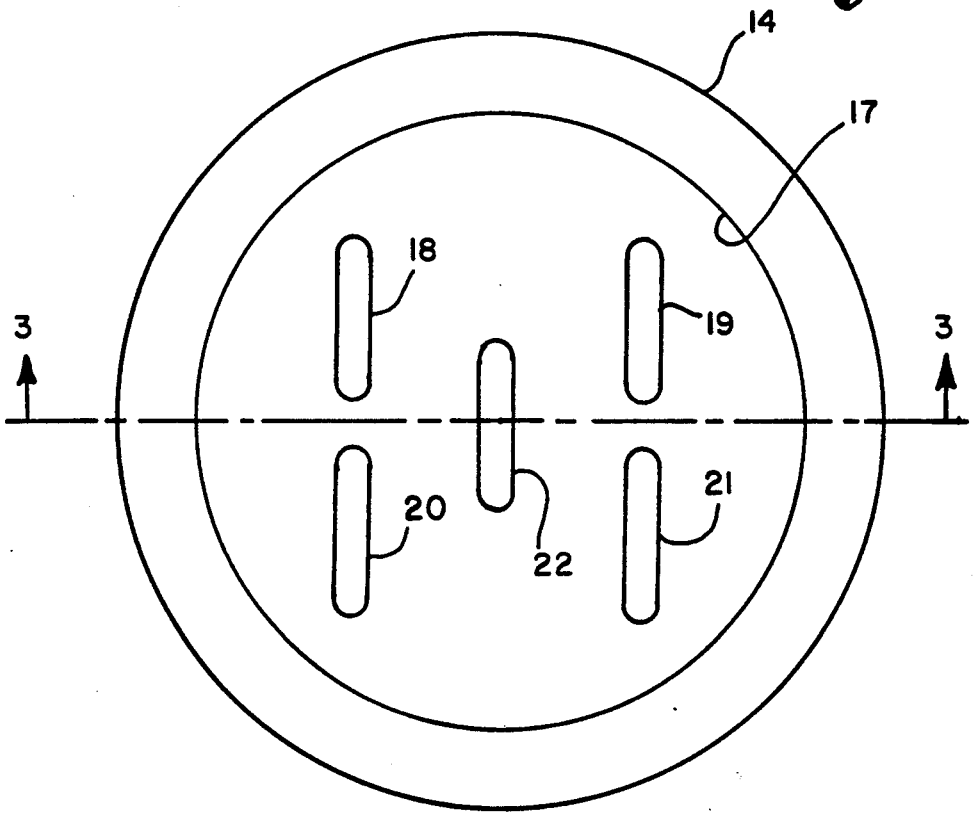
FIG. 4 is a top plan view of the fastening disc shown in FIG. 3.

The second basic component of the binding is a fastening disc or plate 14 (FIGS. 3 and 4). This disc is circular, as seen from the top, and has a radially projecting rim 15 at its upper end. The diameter of the fastening disc 14 corresponds to the diameter of the opening 2, with the radially projecting rim 15 extending over the opening 2 and its annular contact surface 16 engaging the supporting edge 11 of the base plate 1. In the top of the fastening disc or plate 14 a depression 17 is formed of circular disc shape to receive the heads of fastening bolts 23, 24 (see FIG. 1).

The fastening disc 14 has four oblong holes 18, 19, 20, and 21 throughout its thickness to receive fastening bolts. The oblong holes 18 to 21 are arranged in pairs (18, 19 and 20, 21) parallel to each other and in mirror symmetry to the two main axes indicated by dash-dot lines. Finally, the fastening disc 14 is formed with an aperture 22 passing through the center of the circle and serving as a sight window through which the marks applied on the surface of the snowboard may be read.

In FIG. 1 the two components, base plate and fastening disc, are mounted on a snowboard. It may be seen in this sectional view that the base plate 1 rests directly on top of the snowboard and the fastening disc 14 is fixed by screw bolts 23, 24 engaging in threaded bushings 26 in the body of the snowboard 25. The thicknesses of the base plate 1 and of the fastening disc 14 are selected such that some space remains between the top surface of the snowboard 25 and the bottom surface of the fastening disc 14. In this manner it is assured that the projecting rim 15 will always urge the base plate 1 with sufficient force against the snowboard 25 surface to guarantee the required frictional forces for the positive fixing of the base plate.

An elastic rubber ring 27 can be interposed between the projecting rim 15 and the base plate 1 to increase the friction and afford shock damping.

Furthermore, the outer edge of the base plate 1 may be formed as a raised border 29 as this will offer additional stiffening of the base plate and also present a groove-like opening into which an elastic ring 28 can be introduced to enhance the friction and, in a certain sense, also to provide shock damping.

For adjustment of the rotational position of the binding, the bolts are loosened somewhat, whereupon the base plate 1 can be turned about axis 30. Upon reaching the desired position, the bolts are tightened again, and the binding has been readjusted.

To displace the binding in the longitudinal direction of the snowboard, again upon loosening of the bolts, the fastening disc together with the base plate 1 can be shifted along the oblong holes 18 to 21 and then again be fixed by tightening the screw bolts.

It should be noted that although the invention has been described in detail with reference to a plate-type binding, it is equally applicable to soft or shell-type bindings. In that case the bottom side of the shell-type binding serves as base plate 1 which is formed integrally in per se known manner with the other parts of conventional shell-type bindings, such as straps and spoilers. If the fastening disc 14 is mounted such that the oblong holes extend transversely of the longitudinal axis of the board then the position of the binding can be adjusted in this direction which is more important with shell-type bindings than the adjustment in longitudinal direction of the board. If desired, the board can be provided with a plurality of inserts to permit adjustment of the binding in a longitudinal direction.

What is claimed is:

1. A binding for snowboards, comprising:

a rotatable base plate having a top surface and a bottom surface;

means for fastening the base plate to a snowboard having an upper surface;

the bottom surface of the base plate having a friction lining thereon, and in assembled state, being adapted for direct contact with the upper surface of the snowboard;

the base plate being provided with a circular central opening;

a circular fastening disc situated in said circular central opening, said disc having a projecting rim which extends over a portion of the base plate and has a lower contact surface which contacts the top surface of the base plate adjacent the central opening;

an elastomeric ring positioned between the projecting rim of the fastening disc and the top surface of the base plate; and means for fastening the fastening disc to the snowboard comprising four oblong holes for receiving fastening bolts provided in said fastening disc, such oblong holes arranged in pairs parallel to each other, with the respective ends of each of the four oblong holes positioned at the corners of a square.

2. The binding according to claim 1, wherein the fastening disc is formed with a central aperture serving as a sight window.

3. The binding according to claim 1, wherein the base plate has an outer edge with a raised border.

4. The binding according to claim 3, wherein a space is provided between the raised border and the upper surface of the snowboard to house an elastomeric ring.

5. The binding according to claim 1, wherein at least one of the contact surface of the projecting rim of the fastening disc and the surface of the base plate adjacent the central opening is roughened.

6. The binding according to claim 1, wherein at least one of the contact surface of the projecting rim of the fastening disc and the surface of the base plate adjacent the central opening is provided with knurls.

7. The binding according to claim 1, wherein at least one of the contact surface of the projecting rim of the fastening disc and the surface of the base plate adjacent the central opening is provided with teeth.

* * * * *